United States Patent [19]
Gause
[11] 4,452,168
[45] Jun. 5, 1984

[54] APPARATUS FOR DETECTING BREAKS IN STRAND MATERIAL

[75] Inventor: William C. Gause, Baltimore, Md.

[73] Assignee: AT&T Technologies, Inc., New York, N.Y.

[21] Appl. No.: 278,156

[22] Filed: Jun. 29, 1981

[51] Int. Cl.³ ..... D01H 13/16; B65H 25/10
[52] U.S. Cl. ..... 116/200; 57/80; 57/81; 57/265; 226/45; 242/49
[58] Field of Search ..... 116/200; 57/81, 264, 57/80; 226/45; 250/206, 561; 139/370.2; 28/187, 188, 189; 242/36, 28, 49

[56] References Cited

U.S. PATENT DOCUMENTS

| | | | |
|---|---|---|---|
| 3,576,560 | 4/1971 | Vermeulen | 57/81 |
| 3,732,732 | 5/1973 | Trethewey | 374/141 X |
| 3,828,540 | 8/1974 | Pugh | 57/81 |
| 3,880,001 | 4/1975 | Hogan | 73/160 |
| 3,999,695 | 12/1976 | Bradley et al. | 226/1 |
| 4,098,066 | 7/1978 | Stahlecker | 57/80 |
| 4,100,425 | 7/1978 | Ohsawa | 250/561 |
| 4,136,454 | 1/1979 | Jenkins et al. | 33/147 L |
| 4,137,699 | 2/1979 | Stahlecker | 57/264 |
| 4,169,981 | 10/1979 | White et al. | 250/561 |
| 4,232,447 | 11/1980 | Grunder et al. | 33/174 L |
| 4,311,916 | 1/1982 | Schenkel | 250/561 |

*Primary Examiner*—Daniel M. Yasich
*Attorney, Agent, or Firm*—E. W. Somers

[57] ABSTRACT

Apparatus for detecting a twisted pair (21) of conductors includes contact means (60) in the form of a generally semi-circular rocker. One diametrical end portion of the rocker rides on portions of the twisted pair of conductors as they are advanced over a sheave (34). The opposite diametrical end portion of the rocker is caused to be supported in alignment with a sensor (81). Should one of the conductors be missing, perhaps because of a break or equipment malfunction, the rocker is no longer caused to be maintained in a position such that the opposite end portion is aligned with the sensor. This causes the sensor to provide a signal indication of a break and because of its changed position to provide a visual indication to an operator.

7 Claims, 7 Drawing Figures

APPARATUS FOR DETECTING BREAKS IN STRAND MATERIAL

TECHNICAL FIELD

This invention relates to apparatus for detecting breaks in strand material and, more particularly, to apparatus for detecting the presence of a twisted pair of conductors.

BACKGROUND OF THE INVENTION

In the communications industry, cables which connect central offices with distribution centers in subscriber loops generally include a plurality of pairs of individually insulated condutors. Each pair of the conductors is twisted together. While the twist in any pair is commonly unidirectional, present day techniques include a so-called S-Z twist in which the direction of twist is reversed periodically.

A pair of insulated conductors having a unidirectional twist are twisted together in a well-known apparatus. That apparatus includes two supply reels mounted inside a surface of revolution which is generated by a flier bow that is caused to be revolved about the supply reels. As the conductors are payed off the supply reels and fed upwardly through the bow, they become associated together as a twisted pair. The twisted pair of conductors is advanced over sheaves and then through a multi-grooved capstan whereafter it is taken up in a reel that is positioned outside the cone of revolution of the bow.

In a cable manufacturing plant, it is not uncommon to have a large number of twisting apparatus which are arranged in rows having aisles therebetween. typically, one factory operator is assigned to a plurality of twisting apparatus with each of the plurality requiring attention, such as reel handling, at staggered times.

For one reason or another, conductor breaks occur and present problems for the operator. It is obviously advantageous to detect conductor breaks as soon as possible to eliminate wasted machine time and to avoid the pass-through of only one conductor from one of the supply reels to the take up reel. Also, since the tension on strand material which passes through the twisting apparatus is estalished for a pair of conductors, the absence of one conductor causes excessive elongation in the other and renders it unuseable for communication purposes.

In order to detect conductor breaks early on, twisters as they are called in the art, have been equipped with proximity sensors. These sensors have been used by setting the sensitivity to distinguish between the presence of one or two conductor elements which are advanced past the sensor. Unfortunately, the metallic content between one and two conductors, especially in the finer gauge sizes is so insubstantial that precise settings on the sensors are required.

The problem of broken strand detection has been addressed by the prior art, In U.S. Pat. No. 3,999,695, for example, a running filament is passed over a counterweighted cylinder in a manner to cause the cylinder to rotate. Breakage of the filament allows the cylinder to return to a position where it blocks the flow of a fluid from an orifice and causes a measuraanble change in the fluid pressure.

The prior art includes somewhat elaborate arrangements for improving the sensitivity of sensors used for detecting cross-sectional deviations in moving elongated material. In U.S. Pat. No. 4,136,454, laminar material is moved between two rollers, one of which is supported for movement away from the other. A sensor is spaced from the one roller and generates signals in response to displacements of the one roller caused by thickness variations in the laminar material. See also U.S. pat. No. 4,232,447.

What the prior art lacks is an uncomplicated detection apparatus which is particularly suited to detect a missing conductor of a twisted pair. As such, it must be easily integrated with the conventional twister, must be inexpensive, and must be capable of providing a visual indication to an operator.

SUMMARY OF THE INVENTION

The foregoing requirements of a detection apparatus for strand material including a stranded group of conductors such as a pair or a quad are met by the apparatus of this invention. The apparatus includes a rotatably mounted sheave which includes a peripheral groove and moving means for advancing successive increments of a stranded group of conductors into and out of the groove in the sheave. Portions of the conductors advanced past the sheave are engaged by contact means. When the strand material being advanced past the sheave includes the group of the conductors, one portion of the contact means occupies a first position, but when one or more of the conductors is missing, because of a break, for example, it occupies a second position. A sensor is mounted so that it is aligned with the first position of the one portion of the contact means. The contact means is supported relative to the sheave so that when the strand material being advanced past the sheave includes the group of conductors, the engagement of the strand material with the contact means causes the one portion to occupy the first position. This causes the sensor to provide a suitable indication to an operator.

In a preferred embodiment, a rocker arm having a generally semicircular configuration is mounted for rotation about an axis which is transverse to a path of travel of a twisted pair. In a normal mode, one peripheral portion adjacent to a diametrical surface rides on a twisted pair of conductors. Because of the mounting of the one portion relative to the sheave, the engagement of portions of the twisted pair with the one portion of the rocker causes a diametrically opposite portion to be aligned with a proximity sensor. In the event that one of the conductors is missing, the remaining conductor has an outer diameter which is insufficient to engage the one portion and support the rocker with the diametrically opposite portion in alignment with the sensor. As a result, the rocker rotates to a position with the diametrical surface generally horizontal to expose and cause the sensor to provide a detection signal. Advantageously, the non support of the rocker in its sensor-aligned position is easily detected visually by an operator.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 1:
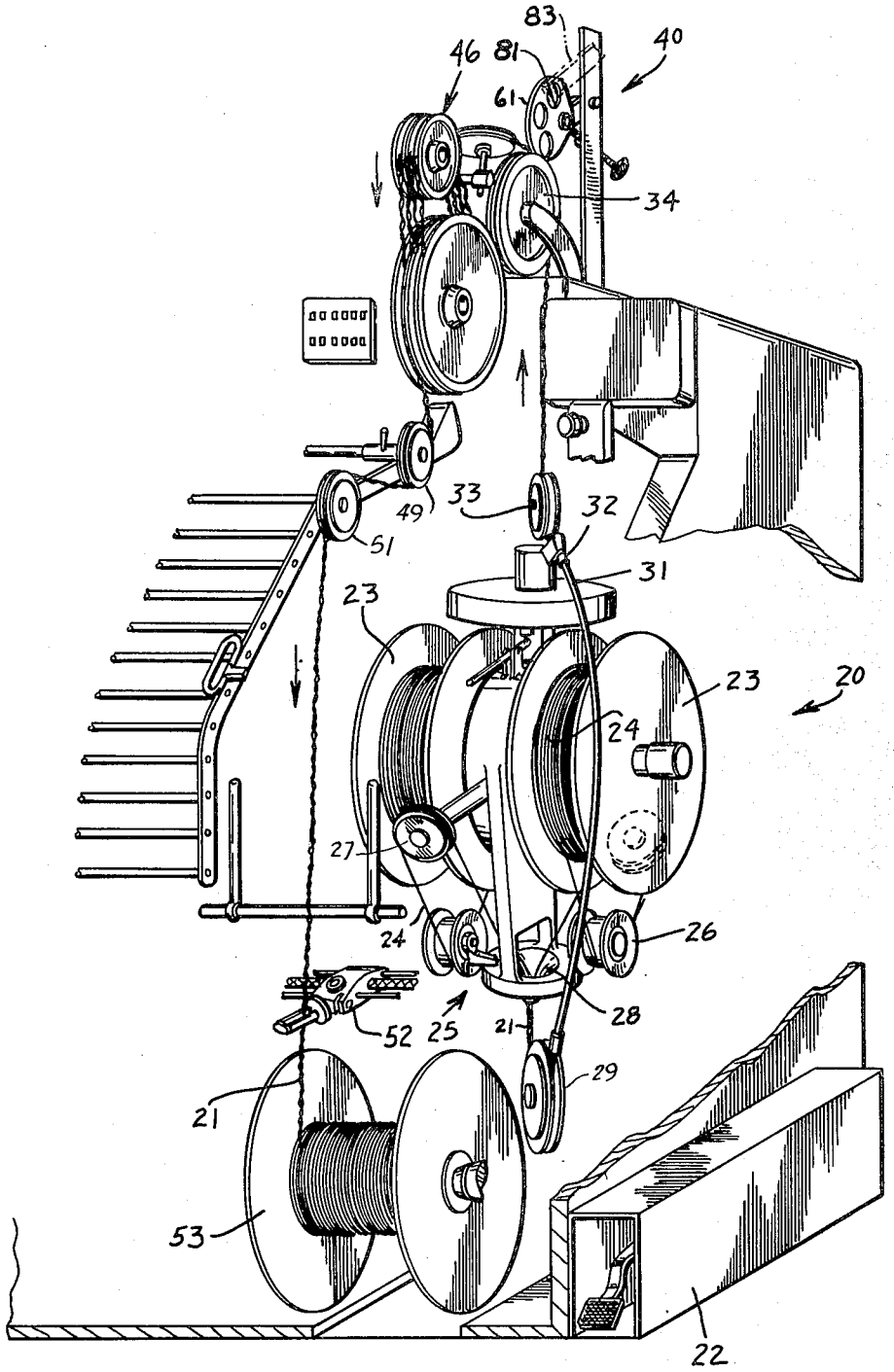
FIG. 1 is an overall perspective view of an apparatus for associating conductors together in a twisted pair and including apparatus for detecting the absence of one of the conductors.

Referring now to FIG. 1, there is shown an apparatus which is designated generally by the numeral 20 and which is used to form a strand material, such as, for example, twisted conductor pair 21. The apparatus 20 includes an enclosure 22 in which are mounted two reels 23—23. Each of the reels 23—23 includes a supply of an insulated conductor 24. The two supply reels 23—23 are mounted on a carriage 25.

Each of the conductors 24—24 is moved from its supply reel 23 into association with the other conductor. This is accomplished by moving each conductor 24 past a take off sheave 26 and a tension arm guide 27. From their associated tension arm guides 27—27, the conductors 24—24 are moved through a bell-mouth guide 28, around a lower flier guide 29 and into a flier bow 31.

The flier bow 31 is a tubular arcuately shaped member which is adapted to cause the conductors 24—24 to become associated together into a twisted pair 21. In order to do this, the flier bow 31 is adapted to be mounted for revolution about the supply reels 23—23. When the conductors 24-24 exit the flier bow 31 at its top most end 32, they are passed around a rotatably mounted upper flier guide 33 and a rotatably mounted pre-capstan sheave 34.

The detection apparatus of this invention includes a device which is designated generally by the numeral 40 and which is capable of detecting the absence of at least one of the conductors 24—24. The device 40 is mounted in the apparatus 20 so that it cooperates with the pre-capstan sheave 34.

While the device 40 is described herein in the environment of a twisting apparatus 20, the invention is not so limited. The device 40 is one for detecting that all the conductors of a plurality which comprise a strand material such as a twisted pair or a quad, for example, are present at some location along a manufacturing line.

After the twisted pair 21 leaves the detection device 40, it is moved in several wraps about a capstan 46. From the capstan 46, which applies the pulling force to move the conductors 24—24 through the flier bow 31, the pair 21 is moved past several tensioning sheaves and arms 49 and 51. The twisted pair 21 is distributed by reciprocally moveable fingers 52—52 on a take-up reel 53 which is mounted in the apparatus 20 such that it is outside the surface of revolution of the flier bow 31.

From the twisting apparatus 20, the reel 53 of the twisted pair 21 is transported to other stations in a cable-making operation such as, for example, stranding. It becomes important to the continuous quality control of the final cable product to be able to make a timely detection of the absence of one or more of the conductors 24—24 at a point just prior to the capstan 46.

Figure 2:
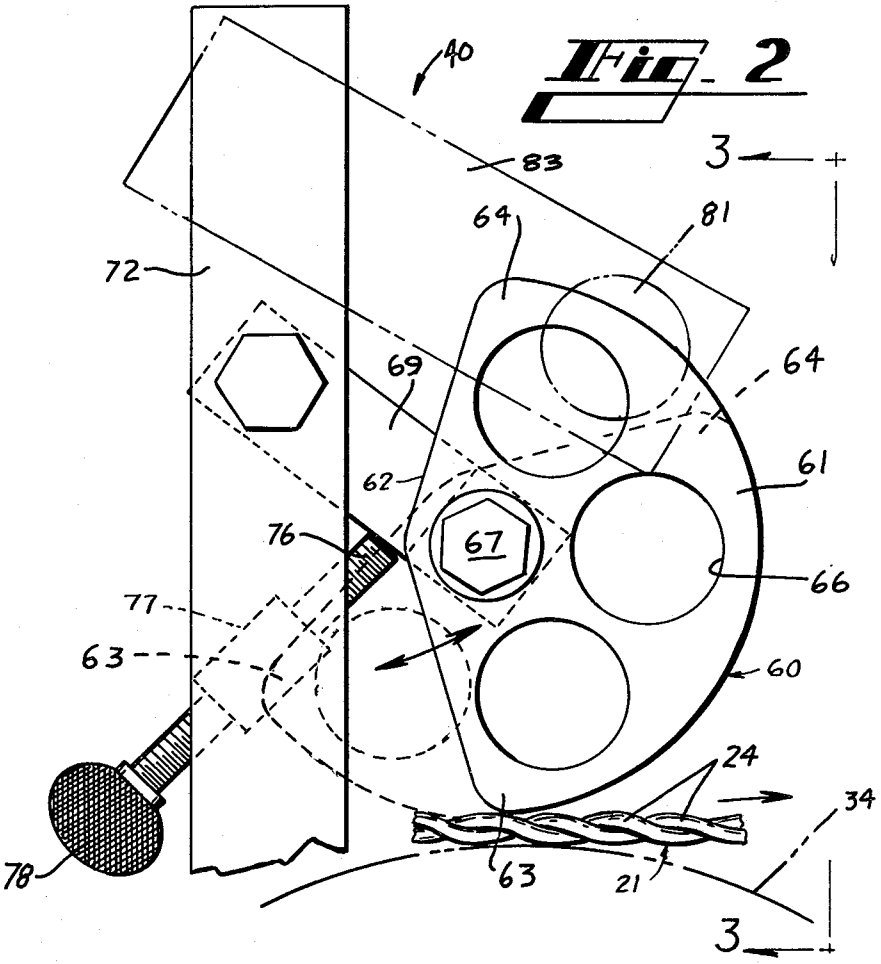
FIG. 2 is a front elevational view of the apparatus of this invention in a position with a twisted pair of conductors being advanced therepast.
Figure 3:
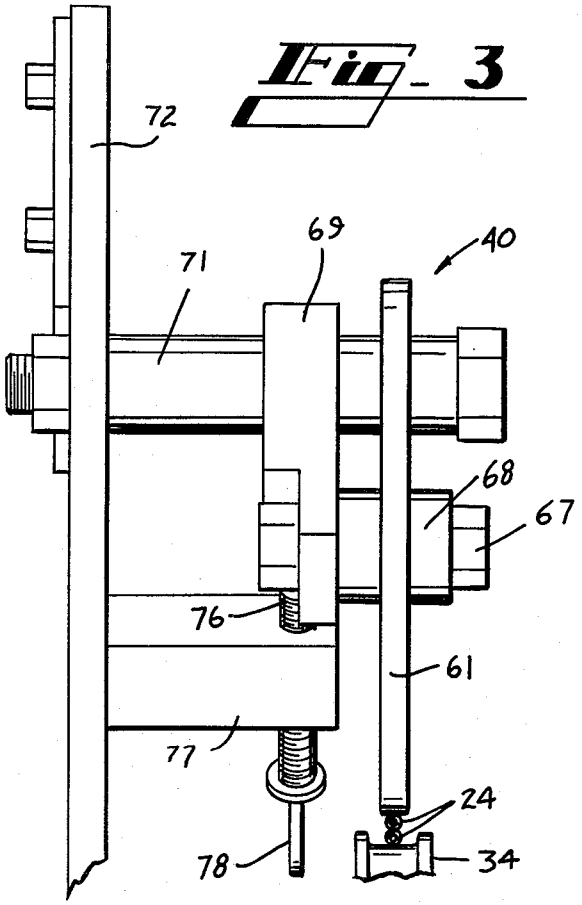
FIG. 3 is an end elevational view of the apparatus in FIG. 2 taken along lines 3—3 thereof.

Going now to FIGS. 2 and 3, there is shown a preferred embodiment of the detection device 40. The device 40 includes strand material contact means 60. The contact means 60 includes a generally semi-circular rocker 61 in the form of a plate having a center diametrical portion 62 and diametrical end portions 63 and 64. The rocker 61 has a plurality of openings 66—66 formed therethrough.

The rocker 61 is mounted pivotally about an axis 67 on a shaft 68 which extends horizontally from a bracket 69. The 69 is supported from a bolt 71 that extends from and is secured to a frame 72 that is part of the enclosure 22.

As can be seen in the drawings, the rocker 61 is supported a predetermined distance from the sheave 34 so that the diametrical end portion 63 engages portions of the twisted pair 21 as it is moved through the groove of the sheave. The position of the rocker 61 for this purpose will vary as a function of the outer diameter of the conductors 24—24 of the pair 21. This position will also vary as a function of the number of the conductors of the strand material being advanced past the sheave 34.

the spacing of the rocker 61 from the sheave 34 must be such that the strand material comprising the plurality of conductors 24—24 may be advanced between the diametrical end portion 63 and the sheave. On the other hand, the spacing must be such that the diameterical end portion 63 will ride on successive portions of the stranded material to cause the other diametrical end portion 64 to be supported in a first position shown in FIG. 2.

Should one or more of the conductors 24—24 be missing, there will be insufficient engagement of the diametrical end portion 63 to maintain the other end portion 64 in the position shown in FIG. 2. In that event, the other end portion 64 is moved into a second position which is shown in broken lines in FIG. 2.

In order to achieve the conductor engagement required for the successful operation of the device 40, the arm 69 is adjustably supported by a stop 76 in the form of a thumbscrew. The stop 76 extends through an internally threaded collar 77 that is mounted in the post 72 and includes a knob 78 at a lower end.

A turning of the knob 78 causes the stop 76 to be moved upwardly to the right as viewed in FIG. 2 or downwardly to the left. The former movement causes the rocker 61 to be moved upwardly from the sheave 34 to accommodate larger conductors 24—24. On the other hand, if the size of the conductors 24—24 is to be reduced, the stop 76 is moved downwardly toward the left to allow the end 63 of the rocker 61 to descend into engagement therewith.

The device 40 also includes a sensor 81 which in an operating mode is designed to be aligned with the diametrical end portion 64 of the rocker 61. The sensor 81 is supported at an end of an arm 83 that is connected to the post 72 in the position shown in FIG. 2. In a normal operating mode with a conductor pair 21 being advanced past the sheave 34, the conductors cause the rocker 61 to be supported in the first position shown in FIG. 2 with the diametrical end portion 64 aligned with the sensor 81. The stop 76 is adjusted for each gauge conductor to cause the rocker 61 to be supported as shown when a conductor pair 21 is advanced past the sheave 34 and to permit the rocker 61 to turn to a non-detectable position in the absence of one or both of the conductors.

Should one or more of the conductors 24—24 be missing while the apparatus 20 is operating, the rocker 61 turns about its axis 67 in a clockwise direction as viewed in FIG. 2 so that its diametrical portion 62 is oriented upwardly. When the rocker 61 occupies its turned position, it should be clear that the diametrical end portion 63 is out of alignment with the sensor 81. As a result, the sensor 81 detects the absence of the rocker 61 and in response thereto generates a signal which may provide an audible alarm or cause the operation of the apparatus to be discontinued.

While in a preferred embodiment, the sensor 81 is a proximity detector which detects the presence of a metallic object such as the rocker 61, other kinds of sensors may be used. For example, a photo-detector arrangement could be used with the rocker 61 in its normal operating mode being effective to break a light beam. When a break occurs and the rocker 61 turns, the light beam is picked up on an opposite side of the plane of the rocker and an appropriate signal is generated. As a result, the sensor 81 is adapted to provide an indication, passive or active, when at least one of the conductors is missing and that less than the predetermined number are being advanced past the sheave 34. Also, it provides an indication, passive or active that the predetermined number is being advanced past the sheave 34.

The preferred embodiment of the detection device is advantageous from another standpoint. Generally, a single factor operator is responsible for the operaion of a number of the twisting apparatus 20. Each apparatus 20 requires supply reels 23—23 at a time different from that of the others. It is usual practice for the plurality of apparatus 20 to be arranged in a row with the factory operator moving back and forth along the row to service those apparatus for which he is responsible. The configuration of the rocker 61 is such that when it has turned 90° from its normal operating work position because of the absence of at least one conductor, its change position is visually detectable by the factory operator from any point along the row. This facilitates the timely repair of any malfunctioning portions of the apparatus 20 and restringing for another cycle.

Figure 6:
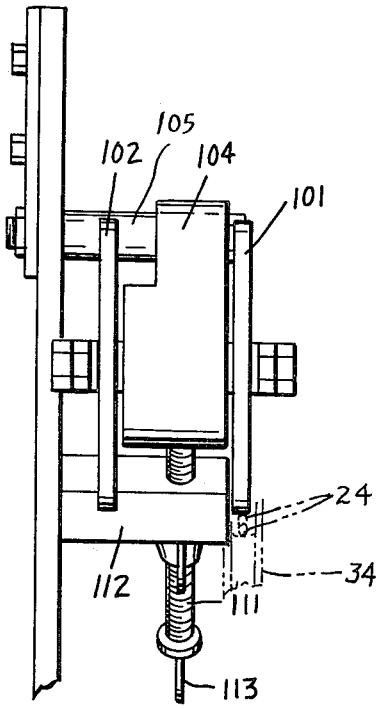
FIG. 6 is an end elevational view of the apparatus of FIG. 4 taken along lines 6—6 thereof.
Figure 5:
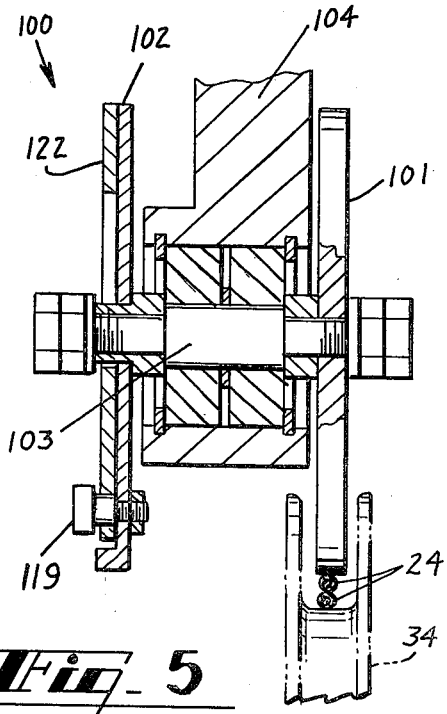
FIG. 5 is an end elevational view of the apparatus of FIG. 4 taken along lines 5—5 thereof.

Turning now to FIGS. 4–7, there is shown an alternative embodiment 100 of the invention. In it, the contact means of the detection device 100 includes a pair of coaxially mounted discs 101 and 102. As can be seen in FIG. 6, the disc 101 is aligned with the sheave 34 and is adapted to engage portions of the twisted pair 21 as the conductors are advanced. As long as a twisted pair 21 is moved through the groove of the sheave 34, the disc 101 is caused to turn thereby turning the sheave 102.

The coaxial discs 101 and 102 are mounted on a shaft 103 that extends through a bushing 104. The bushing 104 is supported from one end of a bracket 105 that is pinned to the support post 72. As in the preferred embodiment, the contact shoe, i.e., the disc 101, is mounted so that its position can be adjusted for different gauge size conductors 24–24. This is accomplished by mounting a thumbscrew 111 to extend from an internally threaded collar 112 that is attached to the post 72. The thumbscrew 111 is adjusted by the factory operator who turns a knob 113 to move the thumbscrew 111 toward the sheaves 101 and 102 or in an opposite direction. An end of the thumbscrew 111 engages and supports the bushing 104.

Figure 4:
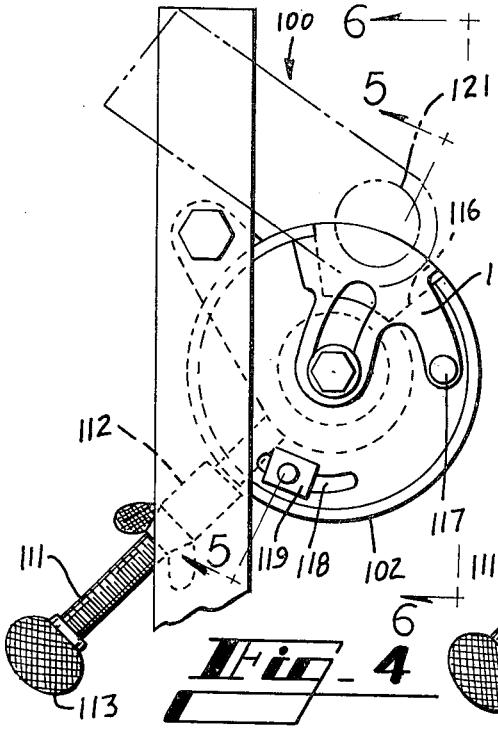
FIG. 4 is a front elevational view of an alternative embodiment of this invention to show a pivotally mounted pawl which is aligned with a sensor.
Figure 7:
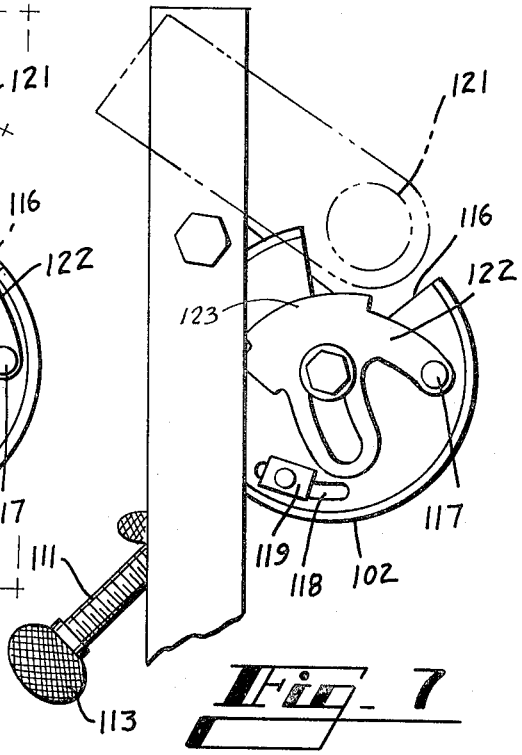
FIG. 7 is a front elevational view of the alternative embodiment of FIG. 4 to show the position of the pivotally mounted pawl in the event of a conductor break.

Going now to FIGS. 4 and 7, it is seen that the disc 102 includes a peripheral opening 116, a peripheral tapped hole 117 and an arcuate, peripherally disposed slot 118. The slot 118 is designed to receive a fastener for holding a counterweight 119 at a position along the slot such that when the disc 107 is in a rest position, the peripheral opening 116 is aligned with a sensor 121. For this condition of alignment of opening and the sensor 121, a signal is generated.

In the normal operating mode with the disc 102 being caused to rotate with the disc 101, the peripheral opening 116 is covered (see FIG. 4) to present a continuous surface to the sensor 121. The covering of the opening 116 is achieved by a pawl 122 which is pivotally mounted by a pin turned into the hole 117. The pawl 122 as depicted in FIGS. 4 and 7 is configured to have a portion 123 that is adapted to cover the opening 116 when the pawl is moved to an outer position.

During operation of the apparatus 20, the passage of a pair 21 between the sheave 34 and the disc 101 causes the disc to rotate, which in turn rotates the disc 102. The rotation of the disc 102 generates centrifugal forces which cause the pawl 122 to be moved pivotally outwardly. As a result, the portion 123 of the disc 102 covers the opening 116 in the disc 102 to prevent the sensor 121 from being controlled to discontinue the operation of the apparatus. On the other hand, should one or both conductors break, the rotation of the disc 101 and of the disc 102 is discontinued. The counterweight 119 is rendered effective to cause the disc 102 to come to rest in a position as shown in FIG. 7 with the opening 116 aligned with the sensor 121. Since the rotation has been discontinued, the pawl 122 is no longer thrown outwardly and moves inwardly pivotally to uncover the opening 116. The sensor 121 detects the uncovered opening and signals the factory operator as well as discontinuing the operation of the apparatus 20.

It is to be understood that the above-described arrangements are simply illustrative of the invention. Other arrangements may be devised by those skilled in the art which will embody the principles of the invention and fall within the spirit and scope thereof.

What is claimed:

1. An apparatus for detecting strand material which comprises a predetermined number of conductors, said apparatus comprising:

a rotatably mounted sheave for guiding the strand material;

moving means for advancing successive increments of the strand material into and out of engagement with said sheave;

contact means spaced a predetermined distance from said sheave for engaging the strand material when the strand material includes a predetermined number of conductors, said contact means having a portion which is adapted to be moved from a first position to a second position when one of the conductors is missing;

mounting means for supporting said contact means the predetermined distance from said sheave to cause sufficient engagement between said contact means and strand material which includes the predetermined number of conductors to cause said portion of said contact means to be disposed in said first position and in the absence of at least one of the conductors to cause said portion of said contact means to be moved to said second position, said mounting means including means for adjusting the predetermined distance between said contact means and said sheave; and sensor means aligned with the first position for detecting the presence of said portion of said contact means to provide an indication that the strand material being advanced past said sheave includes the predetermined number of conductors and for detecting the absence of said portion of said contact means to provide an indication that the strand material does not include the predetermined number of conductors.

2. The apparatus of claim 1, wherein said mounting means includes means for adjusting the predetermined distance in accordance with the number and the outer diameter of the conductors which comprise the strand material and wherein said sensor means includes a photocell.

3. An apparatus for detecting a twisted pair of conductors, said apparatus comprising:

a rotatably mounted sheave having a groove for receiving the twisted pair of conductors;

moving means for advancing successive increments of the twisted pair of conductors into and out of engagement with said sheave;

contact means including a rotatably mounted disc spaced a predetermined distance from said sheave for engaging the twisted pair of conductors, said contact means also including a portion which is adapted to be moved into a first position when the pair is being advanced past said sheave and said disc engages the twisted pair and moved into a second position when at least one of the conductors of the pair is missing;

mounting means for supporting said disc to have an axis of rotation which is normal to the path along which the twisted pair of conductors is being advanced and to have a peripheral edge thereof engage portions of a twisted pair to cause said disc to be engaged and turned rotatably by the conductor pair as it is advanced and to cause said portion of said contact means to be disposed in the first position, said mounting means including means for adjusting the predetermined distance between said disc and said sheave as a function of the outer diameter of the conductors; and sensor means aligned with the first position for detecting the presence of said portion of said contact means to indicate that the pair of conductors is being advanced past said sheave and for detecting the absence of said portion of said contact means to provide an indication that at least one of the conductors is missing.

4. The apparatus of claim 3 wherein said disc is a first disc and wherein said contact means further includes a second disc which is connected to said first disc to be turned rotatably with said first disc, said second disc having an opening adjacent to one portion of its periphery and a counterweight adjustably attached adjacent to another portion of its periphery, said mounting means causing said opening to be aligned with said sensor means when said first disc is not engaged by a twisted pair and the discs are in a rest position, said counterweight being effective when said first disc is not turned by portions of a conductor pair for causing the discs to assume the rest position.

5. The apparatus of claim 4, wherein said contact means further includes a pawl which is mounted pivotally about a pin that extends from a radial surface of said second disc, said pawl being adapted to move pivotally outwardly upon rotation of said discs to cover said peripheral opening of said second disc and upon the discontinuance of rotation in the absence of at least one of the conductors to assume a position which exposes said peripheral opening whereupon said sensor means provides an indication that at least one of the conductors is missing.

6. An apparatus for detecting a twisted pair of conductors, said apparatus comprising:

a rotatably mounted sheave having a groove for receiving a twisted pair of conductors;

moving means for advancing successive increments of a twisted pair of conductors into and out of engagement with said sheave;

contact means spaced a predetermined distance from said sheave for engaging the twisted pair of conductors, said contact means having a pivotally mounted portion which is adapted to be moved from a first position to a second position when at least one of the conductors of the pair is missing;

mounting meanss for supporting said contact means the predetermined distance from said sheave to provide sufficient engagement with successive increments of a twisted pair being advanced past said sheave to cause said pivotally mounted portion of said contact means to be disposed in the first position and in the absence of at least one conductor of the pair to allow said pivotally mounted portion to be moved to the second position, said mounting means including means for adjusting the predetermined distance between said contact means and said sheave as a function of the outer diameter of the conductors; and sensor means aligned with the first position for detecting the presence of said pivotally mounted portion of said contact means in the first position to indicate that a twisted pair of conductors is being advanced past said sheave and for detecting the absence of said pivotally mounted portion in the event that at least one of the conductors is missing.

7. An apparatus for detecting a twisted pair of conductors, said apparatus comprising:

a rotatably mounted sheave having a groove for guilding the twisted pair of conductors;

moving means for advancing successive increments of the twisted pair of conductors into and out of engagement with said sheave;

contact means for engaging the twisted pair of conductors, said contact means including a rocker having a pivotally mounted, generally semi-circular configuration which includes diametrical end portions one of which is adapted to engage the conductor pair as the pair is advanced past said sheave and to cause the opposite one of said diametrical end portions to be maintained in a first position, said one diametrical end portion being spaced a predetermined distance from said sheave when said other diametrical end portion is in the first position;

mounting means for supporting said contact means to produce sufficient engagement with successive increments of a twisted pair being advanced past said sheave to cause said opposite diametrical end portion of said rocker to be disposed in the first position and in the absence of at least one conductor of the pair to allow said opposite end portion of said contact means to become disposed in a second position, said mounting means being such as to cause said rocker to be mounted rotatably about an axis that extends through a point which is located generally at the midpint between said two diametrical end portions of said rocker, said mounting means including means for adjusting the predetermined distance as a function of the outer diameter of the conductors; and sensor means aligned with the first position for detecting the presence of said opposite end portion of said rocker to provide an indication that the pair of conductors is being advanced past said sheave and for detecting the absence of said opposite end portion of said rocker to provide an indication that at least one of the conductors is missing.

* * * * *